US010037751B2

(12) United States Patent
Cudney

(10) Patent No.: US 10,037,751 B2
(45) Date of Patent: Jul. 31, 2018

(54) SINGLE COIL HUM-CANCELLING PICKUP FOR MUSICAL INSTRUMENTS

(71) Applicant: R & M Cudney, Inc., Oakley, CA (US)

(72) Inventor: Russ Cudney, Oakley, CA (US)

( * ) Notice: Subject to any disclaimer, the term of this patent is extended or adjusted under 35 U.S.C. 154(b) by 0 days.

(21) Appl. No.: 15/786,453

(22) Filed: Oct. 17, 2017

(65) Prior Publication Data

US 2018/0108335 A1 Apr. 19, 2018

Related U.S. Application Data

(60) Provisional application No. 62/409,325, filed on Oct. 17, 2016.

(51) Int. Cl.
*G10H 3/14* (2006.01)
*G10H 3/18* (2006.01)
*G10D 3/04* (2006.01)

(52) U.S. Cl.
CPC ..... *G10H 3/181* (2013.01); *G10D 3/04* (2013.01); *G10H 2220/505* (2013.01)

(58) Field of Classification Search
CPC ..... G10H 3/181; G10H 2220/505; G10D 3/04
USPC ..... 84/728
See application file for complete search history.

(56) References Cited

U.S. PATENT DOCUMENTS 4,372,186 A * 2/1983 Aaroe ..... G10H 3/181 84/725
6,525,258 B1 * 2/2003 Powers ..... G10H 3/181 84/728

* cited by examiner

*Primary Examiner* — Jeffrey Donels
(74) *Attorney, Agent, or Firm* — Brian Beverly; Beeson Skinner Beverly, LLP

(57) ABSTRACT

An improved hum-cancelling pickup (humbucker) comprises a single integrated coil. The device includes a bobbin having a top plate and a bottom plate interconnected by a plurality of magnetic pole pieces and a fine enameled wire wound around the magnetic pole pieces a plurality of turns so as to form a coil; the coil having dual inner and outer wrappings each wound around the magnetic pole pieces in a direction reverse of the other wrapping. The inner and outer wrappings of the coil are coupled to a single magnetic field that can be positioned at a single location along the strings of a musical instrument, allowing for improved fidelity of string signals while cancelling signals induced in the coil by ambient magnetic fields.

8 Claims, 9 Drawing Sheets

SINGLE COIL HUM-CANCELLING PICKUP FOR MUSICAL INSTRUMENTS

CROSS-REFERENCE TO RELATED APPLICATIONS

This application claims the benefit of U.S. Provisional Application No. 62/409,325 filed Oct. 17, 2016.

BACKGROUND OF INVENTION

Field of Invention

This invention relates to transducers that convert mechanical vibrations into electrical signals and, in particular, to a single-coil, hum-cancelling pickup for stringed musical instruments.

Discussion of Prior Art

A pickup is a transducer that senses mechanical vibrations produced by a musical instrument, often a stringed instrument such as an electric guitar, and converts the vibrations into an electrical signal that is amplified to produce musical sounds through a loudspeaker. Most electrical instruments use a magnetic pickup, while acoustic instruments often use a piezoelectric pickup.

A magnetic pickup generally consists of a magnet, or a set of magnetic pole pieces, wrapped with a single coil of several thousand turns of fine insulated wire. The pickup is mounted near the strings of an instrument, generally on the body of the instrument, but can also be mounted to the bridge, neck or pickguard such that the strings (generally made of a magnetic material, such as steel) are magnetized by the magnetic field of the pickup. When the strings vibrate, as when, for example, the instrument is being played, the vibrations disturb the magnetic field, change the magnetic flux and induce a signal through the pickup coil.

When playing an instrument with a single-coil magnetic pickup, a hum can be heard through the pickup during quiet sections of the music. The pickup acts as a directional antenna and is prone to picking up, along with the musical signal from the string vibrations, interference from ambient magnetic fields, such as those caused at the frequency of mains electricity ("mains hum"). Common sources of mains hum include, for example, amplifiers, processors, mixers, motors, power lines, or other electrical equipment located in proximity to the instrument.

A humbucking pickup, or humbucker, is a type of magnetic pickup designed to cancel, or "buck," mains hum. A humbucker generally involves two coils instead of one. The two coils are wound in opposite directions of one another and are most often connected in series. Each coil is coupled with a separate magnetic field (magnet or magnetic pieces), the magnetic fields being opposite in polarity. Generally, one of the coils has the north pole of its magnetic field oriented toward the strings ("up"), while the other coil has the south pole of its magnetic field oriented up.

Interference from mains electricity reaches the two coils as common-mode noise, inducing an approximately equal signal in each coil. Since the coils are wound in reverse of one another, the induced signals from mains hum cancel each other out. Meanwhile, the magnetic fields of the coils being out of phase (opposite polarity) in conjunction with the coil windings being out of phase (reverse windings) result in the string signals induced in each coil being in phase with one another. Thus, if the two coils are connected in series, the total string signal is effectively doubled.

Although dual-coil humbuckers effectively reduce mains hum, precise hum cancellation is not possible because the two coils, being paired with separate magnetic fields, are positioned at different physical locations along the strings. Therefore, each coil picks up slightly different disturbances in the magnetic field with which it is coupled, both from the vibrating strings and from mains electricity, such that, despite the phase cancellation, a slight amount of residual "noise" remains in the musical signal.

SUMMARY OF INVENTION

The present invention is directed to an improved hum-cancelling pickup (humbucker) having a single integrated coil.

The device generally comprises a bobbin having a top plate and a bottom plate interconnected by a plurality of magnetic pole pieces and a fine enameled wire wound around the magnetic pole pieces a plurality of turns so as to form a single integrated coil; the coil comprising dual inner and outer wrappings each wound around the magnetic pole pieces in a direction opposite that of the other wrapping.

The inner wrapping includes more turns around the magnetic pole pieces towards the bottom plate than towards the top plate, such that the inner wrapping has a tapered outer edge. The outer wrapping includes more turns around the magnetic pole pieces towards the top plate than towards the bottom plate, such that the outer wrapping has a tapered inner edge corresponding to the outer edge of the inner wrapping and such that the inner wrapping is nested within the outer wrapping. A bend in the wire that connects the inner and outer wrappings is a gradual bend free of any kinks or sharp turns.

The humbucker of the invention has a marked advantage over prior art humbuckers since the inner and outer wrappings of the coil are coupled to a single magnetic field that can be positioned at a single location along the strings of the instrument, allowing for improved hum reduction.

DETAILED DESCRIPTION OF THE ILLUSTRATED EMBODIMENT

Figure 1A:
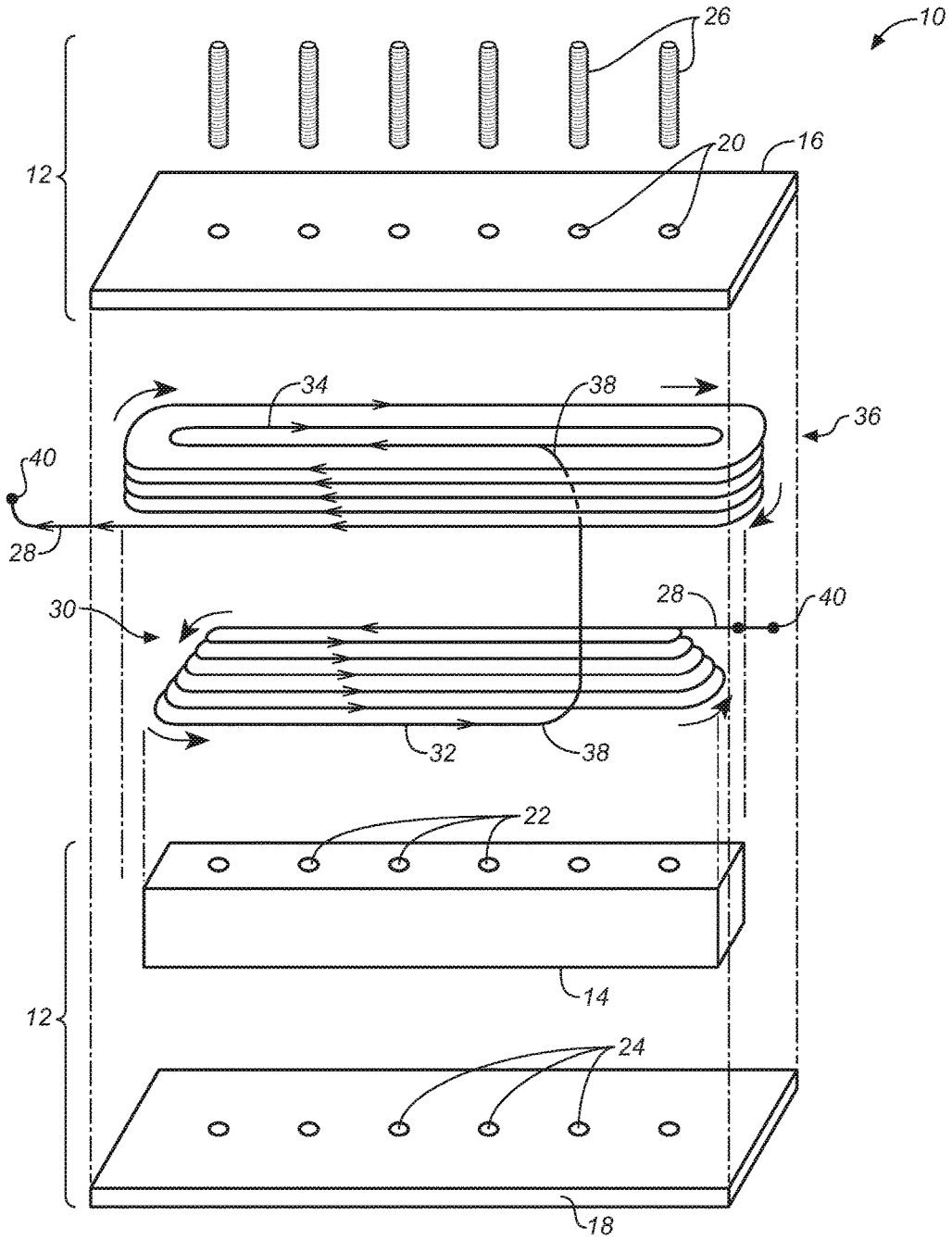
FIG. 1A is an exploded side elevation view of a single-coil hum-cancelling pickup according to the invention.
Figure 1B:
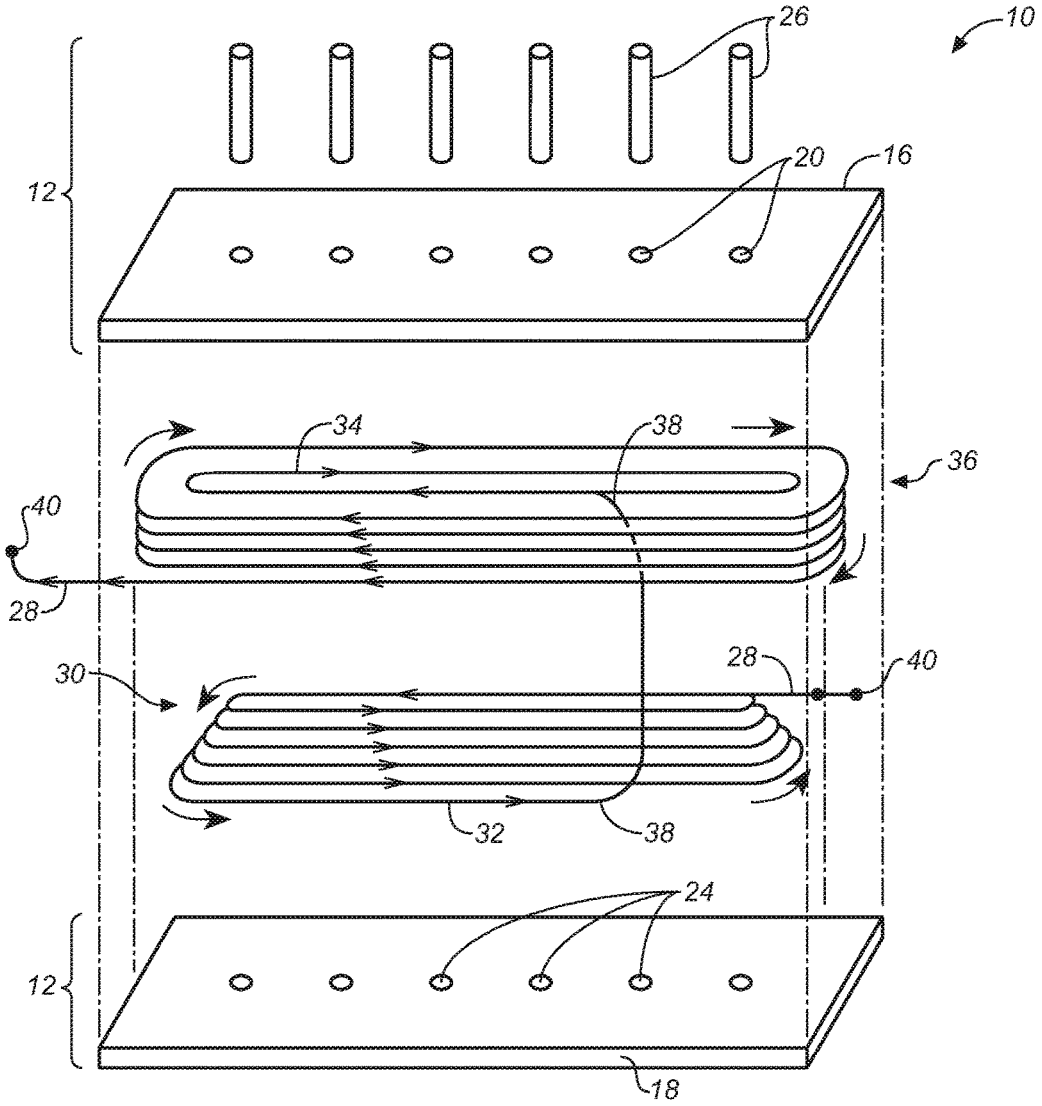
FIG. 1B is an exploded side elevation view of an embodiment of the invention that does not include a core piece between the top and bottom plates.
Figure 2:
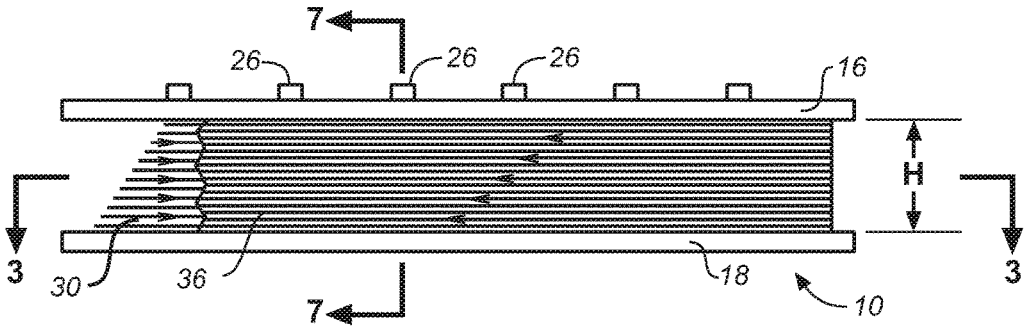
FIG. 2 is a side elevation view of an assembled embodiment of the invention.
Figure 3:
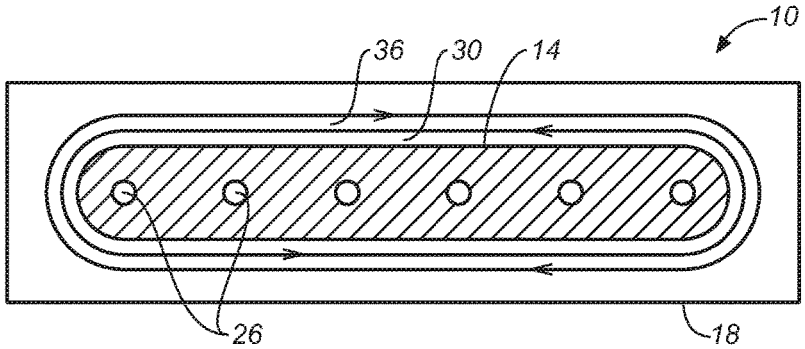
FIG. 3 is a sectional view thereof taken along lines 3-3 of FIG. 2.
Figure 4:
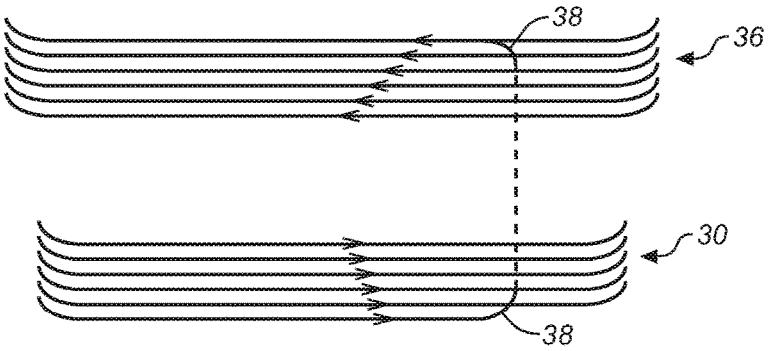
FIG. 4 is a simplified representation of the inner and outer wrappings of the coil thereof showing the interconnecting bend between the two.
Figure 5:
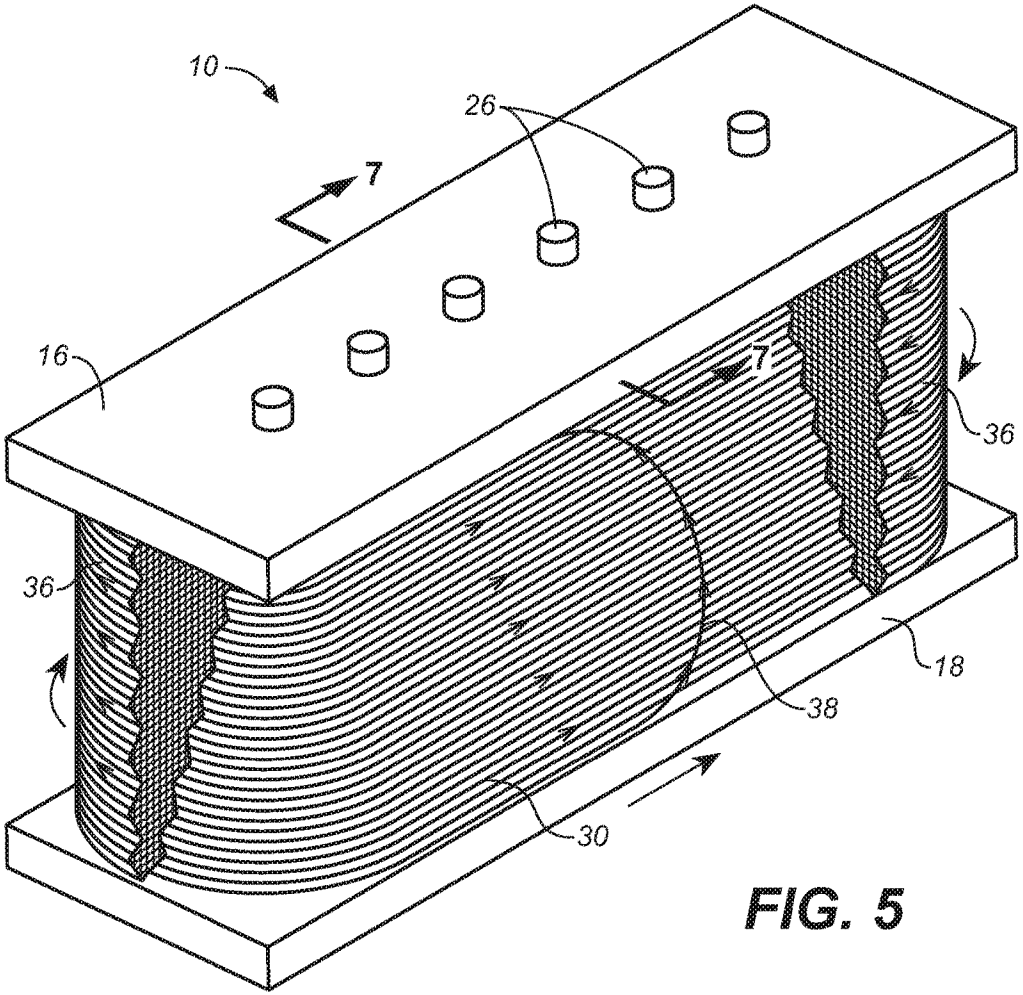
FIG. 5 is an upper perspective view of an assembled embodiment of the invention with a section of the outer wrapping of the coil cut out to show the inner wrapping of the coil.

A single-coil hum-cancelling pickup for musical instruments, now described with respect to the drawings, is referred to generally at numeral 10. The device involves a bobbin 12 comprising a core 14 sandwiched between a top plate 16 and a bottom plate 18 and a plurality of magnetic pole pieces 26. A series of apertures 20, 22, 24 in the top plate, core and bottom plate are aligned to receive the magnetic pole pieces 26 which interconnect the other elements of the bobbin 12. As shown in FIG. 1B, in some embodiments, the core 14 is eliminated and the bobbin 12 comprises top and bottom plates 16, 18 that are interconnected only by the magnetic pole pieces 26.

A single integrated coil 28, generally consisting of a fine enameled copper wire, is wound around the magnetic pole pieces 26 of the bobbin 12 in two wrappings. The coil 28 is wound in a first direction several thousand turns creating a first, inner wrapping 30. In the illustrated embodiments, the inner wrapping is wound in the counter-clockwise direction. The end turn 32 of the inner wrapping 30 of the coil is connected to the beginning turn 34 of a second, outer wrapping 36 of the coil at bend 38. Bend 38 thus forms the transition of the coil from the inner wrapping 30 to the outer wrapping 36.

The outer wrapping 36 is created by winding the coil 28 around the inner wrapping 30 in a direction opposite that of the inner wrapping 30. In the illustrated embodiments, the outer wrapping 36 is wound in the clockwise direction.

The pickup of the invention, therefore, involves a single integrated coil formed from a continuous single wire, the coil comprising dual inner and outer wrappings wherein each wrapping is wound around the magnetic pole pieces of the pickup in a direction that is the opposite of the other wrapping. Each end of the single wire coil is connected to one of two terminals 40 that are connected to an amplifier or recording device.

Figure 6:
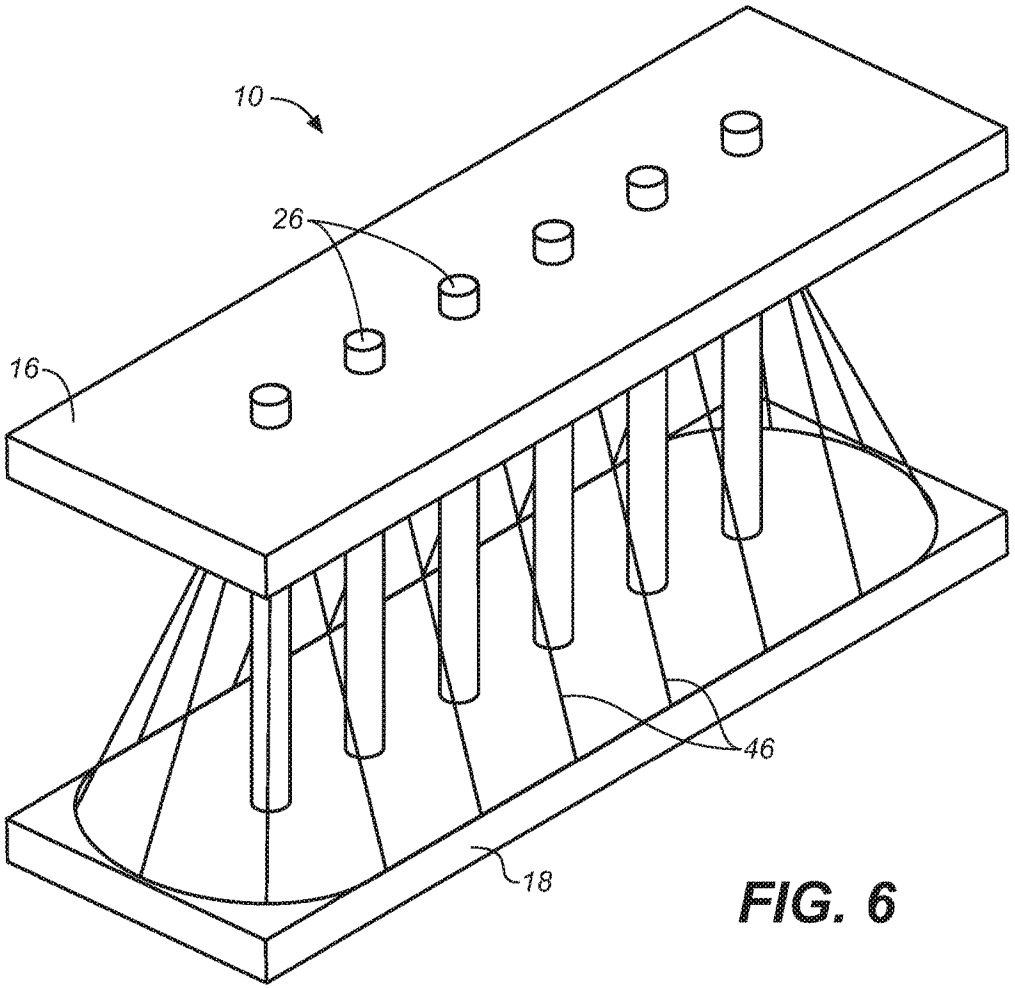
FIG. 6 is an upper perspective wire frame view thereof showing the interface between the inner and outer wrappings of the coil.
Figure 7:
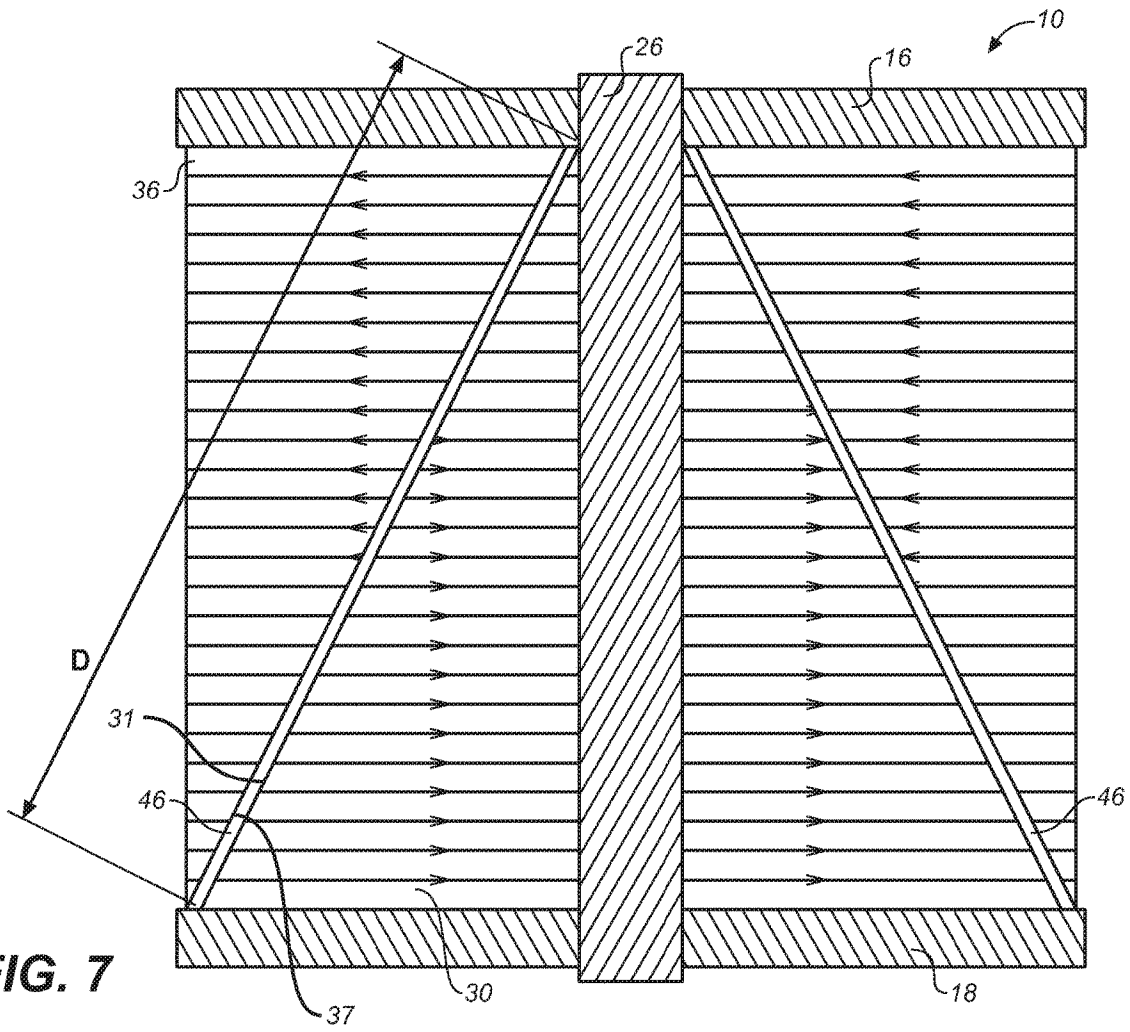
FIG. 7 is a sectional view of an assembled embodiment of the invention taken along lines 7-7 of FIGS. 2 and 5.

In the illustrated embodiment, the inner wrapping 30 has more turns towards the bottom plate 18 than towards the top plate 16 such that the inner wrapping has a tapered outer edge, and the outer wrapping 36 has more turns towards the top plate 16 than towards the bottom plate 18 such that the outer wrapping 36 has a tapered inner edge corresponding to the outer edge of the inner wrapping 30, and such that the inner wrapping 30 is nested within the outer wrapping 36. Reference lines 46 shown in FIGS. 6 and 7 mark the interface between the tapered outer edge 31 of the inner wrapping 30 and the tapered inner edge 37 of the outer wrapping 36. Bend 38 is thus formed on the outer turns of the inner wrapping 30, i.e., along interface 46.

In the illustrated embodiment, the inner wrapping 30 is wrapped around the magnetic pole pieces the same number of turns as the outer wrapping 36. In some embodiments of the invention, the inner wrapping 30 comprises approximately the same length of wire as the outer wrapping 30, such that the halfway point 44 of bend 38 is also the approximate halfway point of the total length of wire.

The tapered configurations as described above cause each of inner and outer wrappings 30,36 to be formed from approximately the same length of wire as the other, while positioning the wrappings in approximately the same perpendicular disposition from the strings and in the same axial disposition along the strings. This allows signals in each wrapping induced from mains electricity to be of equal strength, and since the wrappings are wound in opposite directions, the signals cancel out. Meanwhile, the tapered configurations also allow for the string signals induced in each of the wrappings to be induced by vibrations at the same axial location along the strings of the instrument, such that the combined string signals of the wrappings represent a more precise doubling of the string signal, resulting in a higher fidelity sound.

Figure 8:
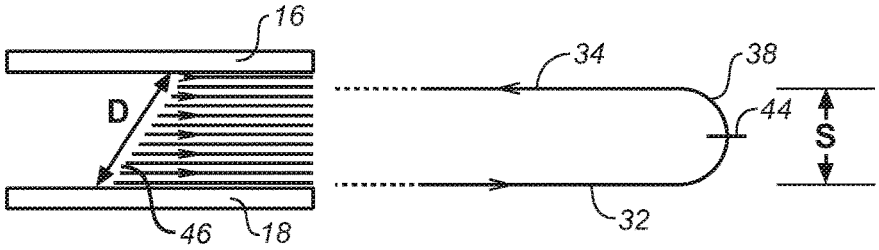
FIG. 8 is a simplified representation of the bend forming the connection between the inner and outer wrappings of the coil.
Figure 9A:
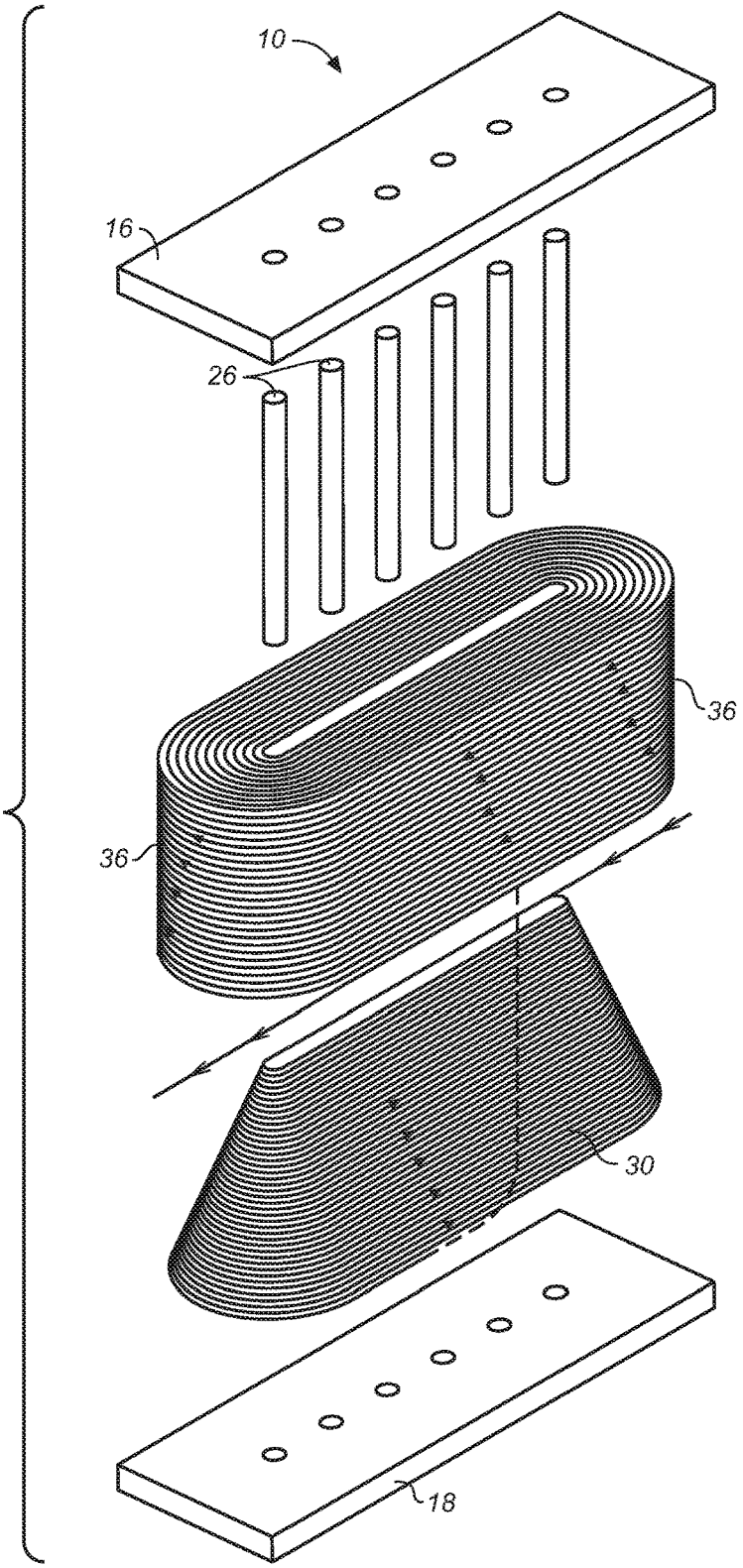
FIG. 9A is an exploded upper perspective view of an embodiment of the invention.
Figure 9B:
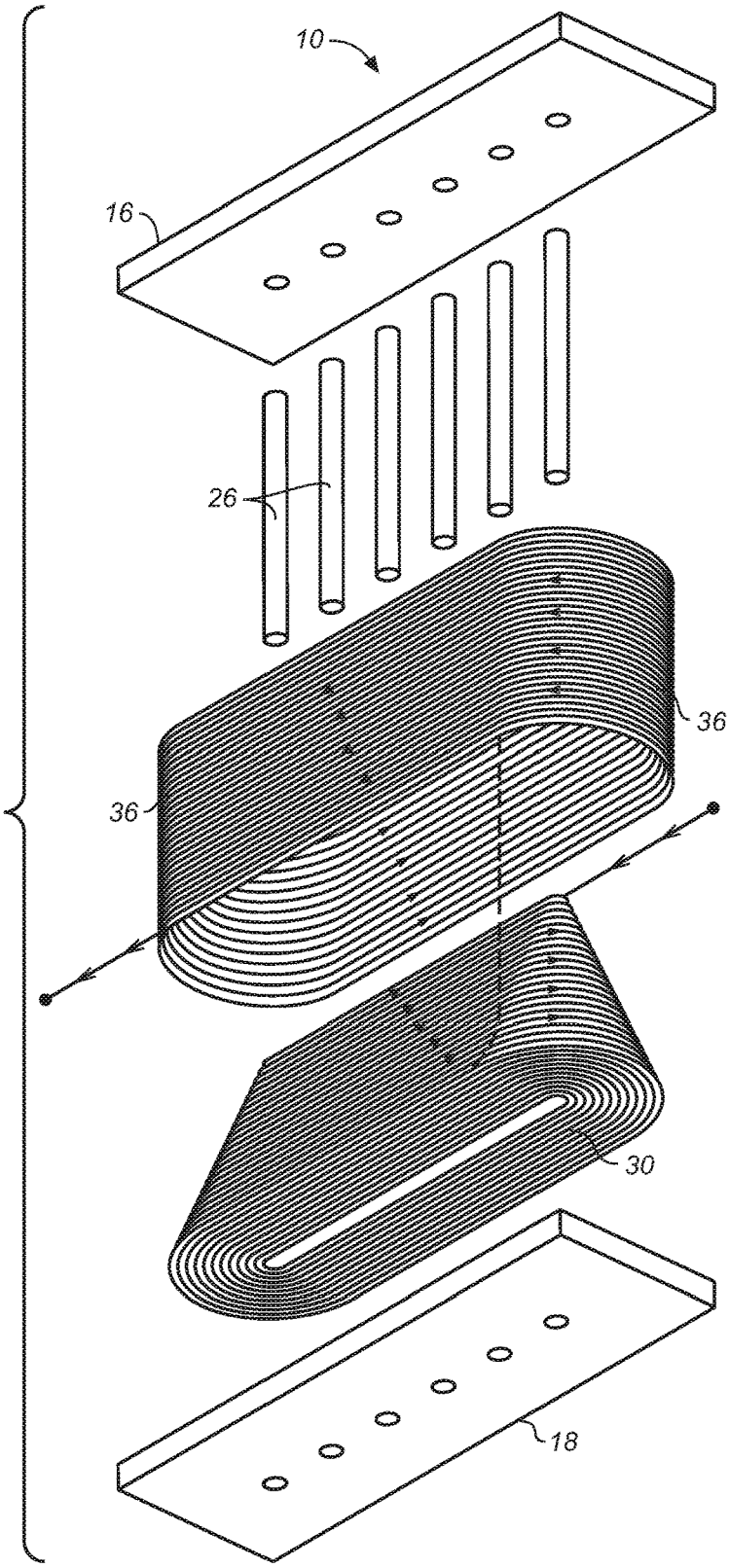
FIG. 9B is an exploded bottom perspective view hereof.

With reference to FIG. 8, the bend 38 establishes a spacing S between the end turn 32 of the inner wrapping 30 and the beginning turn 34 of the outer wrapping 36. Optimally, the bend 38 should be large enough that spacing S is at least half the distance D, where distance D is determined by the shortest distance along interface 46 between the top and bottom plates 16, 18 of the bobbin. In the illustrated embodiment, the bend 38 is formed in a semi-circle having a radius of between one-quarter to one-half the distance D. Thus, for a pickup in which the shortest distance D along interface 46 between the top and bottom plates is ½", the bend should have a radius of at least ⅛" to form a spacing S of at least ¼" (an optimal spacing S equal to ⅜ of D was found to be most effective for the pickup to cancel hum while still generating a signal from the vibrations of the strings).

In other embodiments of the device, the spacing S between the end turn 32 of first wrapping 30 and the beginning turn 34 of second wrapping 36 can be created by a bend having a shape other than a semicircle, so long as the bend is a gradual bend that does not include any kinks or sharp turns and so long as the spacing S of the bend is at least half the distance D.

A single coil hum-cancelling pickup according to the invention has a marked advantage over prior art humbuckers since the inner and outer wrappings of the coil are coupled to a single magnetic field. As a result, the vibrating strings and the mains electricity act on dual wrappings located at a single position along the strings of the instrument, allowing for improved phase cancellation of the mains hum and a more precise doubling of the string signal. The resulting signal produces a pleasing sound having further reduced hum in comparison to signals produced by prior art hum-cancelling pickups that utilize two coils.

There have thus been described and illustrated certain embodiments of a single-coil hum-cancelling pickup for musical instruments according to the invention. It should be clearly understood that the disclosure is illustrative only and is not to be taken as limiting, the spirit and scope of the invention being limited only by the terms of the appended claims and their legal equivalents.

What I claim is:

1. A single-coil hum-cancelling pickup for musical instruments comprising:

one or more magnets, a top plate and a bottom plate interconnected by the one or more magnets, and a wire wound around the one or more magnets a plurality of turns so as to form a single integrated coil disposed between the top and bottom plates, said coil comprising a first, inner wrapping wound in a first winding direction and a second, outer wrapping wound in a second winding direction opposite the first winding direction, the inner wrapping including more turns around the one or more magnets towards the bottom plate than towards the top plate such that the inner wrapping has a tapered outer edge and the outer wrapping including more turns around the one or more magnets towards the top plate than towards the bottom plate such that the outer wrapping has a tapered inner edge corresponding to the outer edge of the inner wrapping.

2. The single-coil hum-cancelling pickup of claim 1 wherein: said inner and outer wrappings are interconnected by a bend in the wire that extends from an end turn of the first, inner wrapping and leads into a beginning turn of the second, outer wrapping, said bend being free of any kinks or sharp turns.

3. The single-coil hum-cancelling pickup of claim 2 wherein: said bend establishes a spacing between the end turn of the inner wrapping and the beginning turn of the outer wrapping, said bend being large enough that said spacing is at least half the shortest distance along the inner edge between said top and bottom plates.

4. The single-coil hum-cancelling pickup of claim 2 wherein: said bend is formed as a semi-circle having a radius of between one-quarter and one-half the shortest distance along the inner edge between said top and bottom plates.

5. The single-coil hum-cancelling pickup of claim 1 wherein: the inner wrapping and the outer wrapping each comprise the same number of turns around the one or more magnets.

6. The single-coil hum-cancelling pickup of claim 1 wherein: the inner wrapping and the outer wrapping each comprise approximately the same length of wire.

7. A single-coil hum-cancelling pickup for musical instruments comprising:

a bobbin including a top plate and a bottom plate interconnected by a plurality of magnetic pole pieces, and a fine enameled wire wound around the magnetic pole pieces a plurality of turns so as to form a single integrated coil, said coil comprising a first, inner wrapping wound in a first winding direction and a second, outer wrapping wound in a second winding direction opposite the first winding direction, and said inner and outer wrappings being interconnected by a bend in the wire that extends from an end turn of the first, inner wrapping and leads into a beginning turn of the second, outer wrapping, said bend being free of any kinks or sharp turns, the inner wrapping including more turns around the magnetic pole pieces towards the bottom plate than towards the top plate such that the inner wrapping has a tapered outer edge and the outer wrapping including more turns around the magnetic pole pieces towards the top plate than towards the bottom plate such that the outer wrapping has a tapered inner edge corresponding to the outer edge of the inner wrapping.

8. A single-coil hum-cancelling pickup for musical instruments comprising:

a bobbin including a top plate and a bottom plate interconnected by a plurality of magnetic pole pieces, and a fine enameled wire wound around the magnetic pole pieces a plurality of turns so as to form a single integrated coil, said coil comprising a first, inner wrapping wound in a first winding direction and a second, outer wrapping wound in a second winding direction opposite the first winding direction, said inner and outer wrappings each comprising approximately the same number of turns around the plurality of magnetic pole pieces, and said inner and outer wrappings being interconnected by a bend in the wire that extends from an end turn of the first, inner wrapping and leads into a beginning turn of the second, outer wrapping, said bend being free of any kinks or sharp turns, the inner wrapping including more turns around the magnetic pole pieces towards the bottom plate than towards the top plate such that the inner wrapping has a tapered outer edge, and the outer wrapping including more turns around the magnetic pole pieces towards the top plate than towards the bottom plate such that the outer wrapping has a tapered inner edge corresponding to the outer edge of the inner wrapping, and said bend establishing a spacing between the end turn of the inner wrapping and the beginning turn of the outer wrapping, said bend being large enough that said spacing is at least half the shortest distance along the inner edge between said top and bottom plates.

* * * * *